US010041297B2

(12) United States Patent
Austin et al.

(10) Patent No.: US 10,041,297 B2
(45) Date of Patent: Aug. 7, 2018

(54) LADDER

(71) Applicant: Black & Decker Inc., Newark, DE (US)

(72) Inventors: Lauren M. Austin, Owings Mills, MD (US); Michael W. Roberts, Red Lion, PA (US)

(73) Assignee: Black & Decker, Inc., Newark, DE (US)

( * ) Notice: Subject to any disclaimer, the term of this patent is extended or adjusted under 35 U.S.C. 154(b) by 115 days.

(21) Appl. No.: 15/006,804

(22) Filed: Jan. 26, 2016

(65) Prior Publication Data

US 2016/0215561 A1 Jul. 28, 2016

Related U.S. Application Data

(60) Provisional application No. 62/107,661, filed on Jan. 26, 2015.

(51) Int. Cl.

| | |
|---|---|
| ***B25F 5/00*** | (2006.01) |
| ***E06C 7/14*** | (2006.01) |
| ***E06C 7/00*** | (2006.01) |
| ***E06C 7/42*** | (2006.01) |
| *E06C 7/12* | (2006.01) |
| *E06C 7/48* | (2006.01) |

(52) U.S. Cl.

CPC ..... *E06C 7/14* (2013.01); *E06C 7/00* (2013.01); *E06C 7/42* (2013.01); *E06C 7/12* (2013.01); *E06C 7/48* (2013.01)

(58) Field of Classification Search

CPC ..... B25F 5/02; B25F 5/00; B25B 21/00

USPC ..... 211/69, 70.6

See application file for complete search history.

(56) References Cited

U.S. PATENT DOCUMENTS

| | | | | |
|---|---|---|---|---|
| 6,279,741 | B1 * | 8/2001 | Arvin | B25H 3/006 206/349 |
| 6,525,511 | B2 * | 2/2003 | Kubale | B25F 5/02 320/112 |
| 6,621,246 | B2 * | 9/2003 | Kubale | B25F 5/02 320/112 |
| 6,806,680 | B2 * | 10/2004 | Zeiler | H02J 7/1415 320/107 |
| 7,443,137 | B2 * | 10/2008 | Scott | B25F 5/02 320/114 |
| 8,148,000 | B2 * | 4/2012 | Furuta | B25F 5/02 206/703 |

(Continued)

*Primary Examiner* — Bradley Duckworth
(74) *Attorney, Agent, or Firm* — Gabriel A. Haboubi

(57) ABSTRACT

According to an embodiment, a ladder includes a side rail having top and bottom ends; at least two rungs connected to the side rail; a top cap disposed near the top end of the side rail; and a foot protrusion mounted to the top cap and shaped to physically engage a battery pack slot of a power tool, such that attaching the power tool to the foot protrusion secures the power tool to the top cap. According to another embodiment, a power tool storage apparatus, includes a base member shaped to be secured to a storage surface; and a tool engaging portion extending from the base member. The tool engaging portion is shaped to physically engage a battery pack slot of a power tool, such that attaching the power tool to the tool engaging portion secures the power tool to the storage surface. Other embodiments are also disclosed.

5 Claims, 9 Drawing Sheets

(56) References Cited

U.S. PATENT DOCUMENTS

| | | | | |
|---|---|---|---|---|
| 2002/0125857 | A1* | 9/2002 | Mastaler | H02J 7/0045 320/112 |
| 2007/0210744 | A1* | 9/2007 | Watson | B25F 5/00 320/112 |
| 2007/0227310 | A1* | 10/2007 | Roehm | B25F 5/021 81/54 |
| 2007/0229027 | A1* | 10/2007 | Roehm | B25F 5/021 320/114 |
| 2009/0045088 | A1* | 2/2009 | McCray | B25F 5/029 206/349 |
| 2017/0126038 | A1* | 5/2017 | Yoshikawa | H02J 7/0044 |

* cited by examiner

LADDER

CROSS-REFERENCE TO RELATED APPLICATION

The present application derives priority from U.S. Provisional Application No. 62/107,661, filed Jan. 26, 2015, which is incorporated herein by reference in its entirety.

FIELD

This invention relates generally to storage work facilitation.

SUMMARY

According to an embodiment, a ladder includes a side rail having top and bottom ends; at least two rungs connected to the side rail; a top cap disposed near the top end of the side rail; and a foot protrusion mounted to the top cap and shaped to physically engage a battery pack slot of a power tool, such that attaching the power tool to the foot protrusion secures the power tool to the top cap.

According to another embodiment, a power tool storage apparatus, includes a base member shaped to be secured to a storage surface; and a tool engaging portion extending from the base member. The tool engaging portion is shaped to physically engage a battery pack slot of a power tool, such that attaching the power tool to the tool engaging portion secures the power tool to the storage surface.

According to another embodiment, a method is provided for securing a power tool to a storage surface using a storage apparatus. The storage apparatus includes a base member shaped to be secured to the storage surface; and a tool engaging portion extending from the base member. The tool engaging portion is shaped to physically engage a battery pack slot of a power tool. The method includes securing the base member of the storage apparatus to the storage surface; removing a battery pack, if present, from the power tool; and sliding the power tool relative to the tool engaging portion of the storage apparatus, such that the battery pack slot of the power tool engages the tool engaging portion of the storage apparatus.

Other embodiments and features are disclosed herein.

BRIEF DESCRIPTION OF THE DRAWINGS

The accompanying drawings illustrate preferred embodiments of the invention according to the practical application of the principles thereof, and in which.

DETAILED DESCRIPTION

The invention is now described with reference to the accompanying figures, wherein like numerals designate like parts. FIGS. 1-21 refer to a ladder 100 which may include side rails 101 and rungs 102. Persons skilled in the art shall recognize that while the ladder 100 shown in FIGS. 1-21 is an extension ladder, the inventions described in this specification can be implemented on step ladders, platform ladders, multi-purpose ladders, telescoping ladders, etc.

Figure 1:
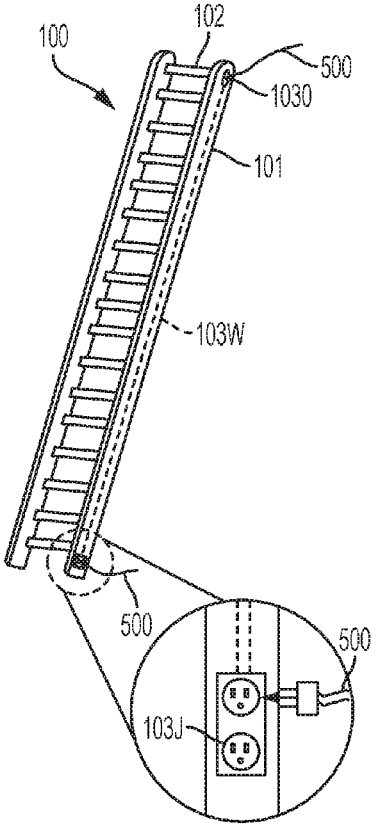
FIG. 1 illustrates a first embodiment of a ladder according to the invention.

Referring to FIG. 1, two or more outlets 103J may be provided on a side rail 101, with one outlet 103J preferably being provided at the bottom of side rail 101 and another outlet 103J being provided at the top of side rail 101. A wire 103W connects the outlets 103J. In this manner, a user can connect an extension cord 500 to the bottom outlet 103J and an extension cord or power tool to the top outlet 103J to power such power tool or other electrical device.

Figure 3:
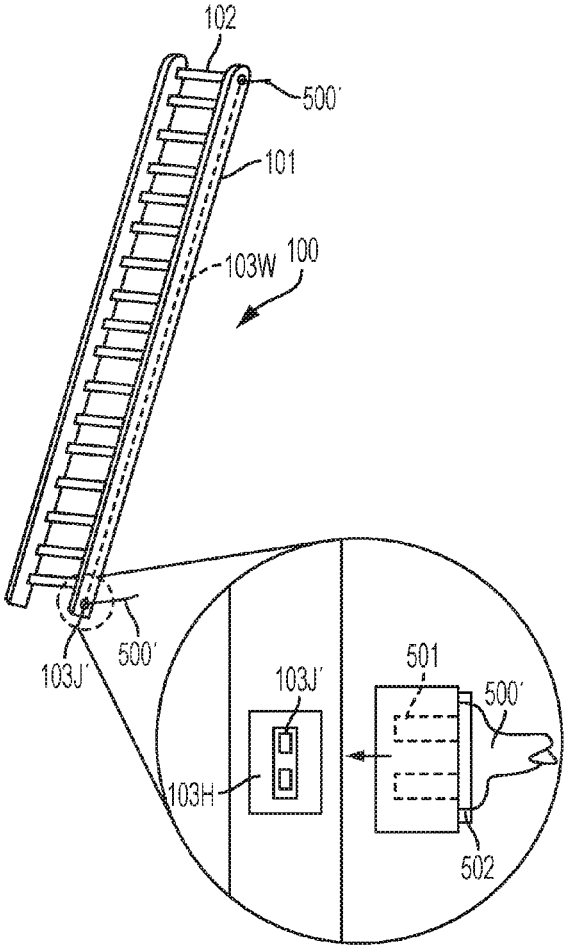
FIG. 3 illustrates a third embodiment of a ladder according to the invention.

While extension cord 500 may be a typical two- or three-bladed AC connector that can be plugged into a standard outlet, it may be preferable to provide an extension cord 500 that has a magnetic end for easy disconnection if somebody pulls or trips on extension cord 500. FIG. 3 shows such arrangement, where extension cord 500' has blades 501 which can be inserted into outlet 103J'. Outlet 103J' may have a ferromagnetic support or wall 103H that can magnetically engage a magnet 502 in extension cord 500'. Persons skilled in the art shall recognize that blades 501 can be disposed in the typical two- or three-bladed AC arrangement or in any other pattern as desired.

Figure 4:
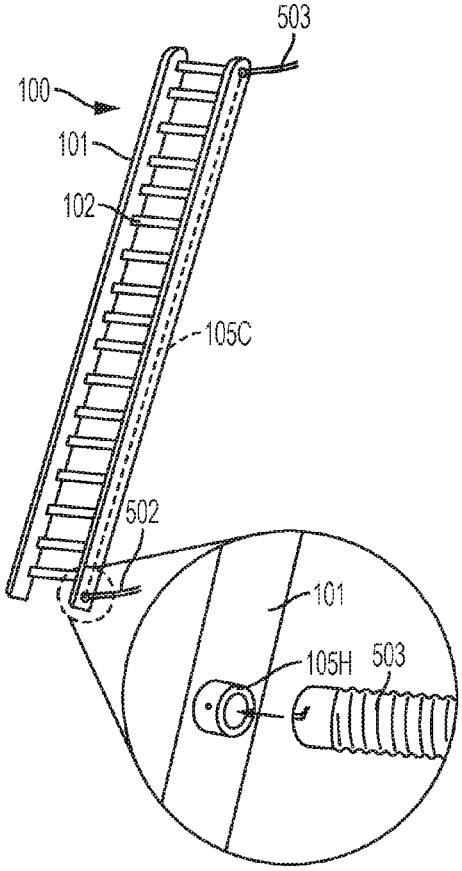
FIG. 4 illustrates a fourth embodiment of a ladder according to the invention.

Referring to FIG. 4, side rail(s) 101 may have a channel 105C connected to hose connectors 105H preferably disposed at the bottom and top of side rail(s) 101. In this manner, a user can connect a hose 503 to a vacuum or blower at one end, and to the hose connector 10511 at the bottom of side rail 101, then connect a hose 503 to the hose connector 105H at the top of side rail 101, and use the top hose 503 to vacuum or blow at a higher altitude compared to the location of the vacuum. Hose 503 may be connected to hose connector 105H with a typical twist-lock or threaded connection. Persons skilled in the art will recognize that a user could also connect a garden hose and use channel 105C to conduct water through side rail 101 as well.

Figure 2:
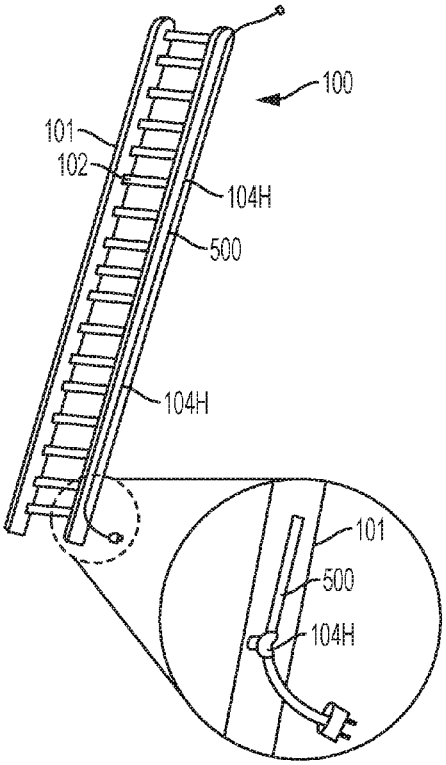
FIG. 2 illustrates a second embodiment of a ladder according to the invention.

Referring to FIG. 2, an alternative ladder 100 has cord holders 10411 disposed along side rail(s) 101 to hold an extension cord 500. In this manner, the user can connect an extension cord connected to an AC outlet or generator to extension cord 500. The user can then connect a power tool or electric device to extension cord 500 at the top of ladder 100. Persons skilled in the art will recognize that cord holders 104H could be design to hold vacuum hoses, like hose 503, and/or garden hoses.

Figure 5:
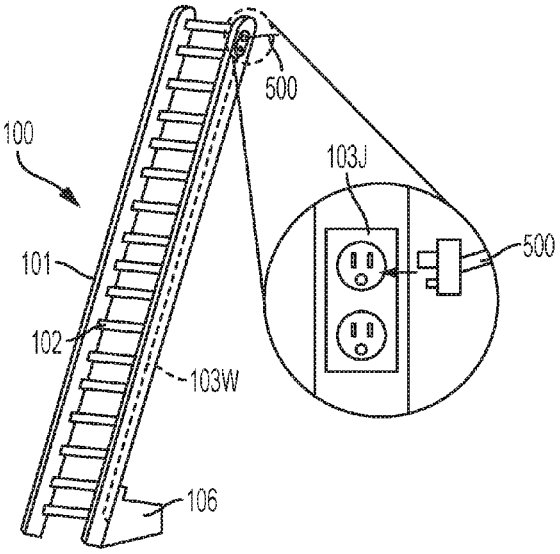
FIG. 5 illustrates a fifth embodiment of a ladder according to the invention.

Referring to FIG. 5, ladder 100 may have a base 106 which may have rechargeable batteries therein, to effectively create a portable power supply described in US Publication Nos. 20080266913 and 20110090726, which are hereby incorporated herein by reference. Alternatively 106 may have an inverter and accept several separable power tool battery packs, such as the battery packs described in U.S. Pat. No. 7,598,705, which is hereby incorporated herein by reference. The AC output of base 106 can be conducted via wire 103W and provided at outlet 103J, which is preferably disposed at the top end of side rail(s) 101. With such arrangement a user can connect a power tool or electric device (or an extension cord 500) to outlet 103J, driving the power tool or electric device off the power supply in base 106.

Persons skilled in the art will recognize that providing such base 106 may also enhance the stability of ladder 106 due to the weight of the portable power supply and/or battery packs.

Figure 6:
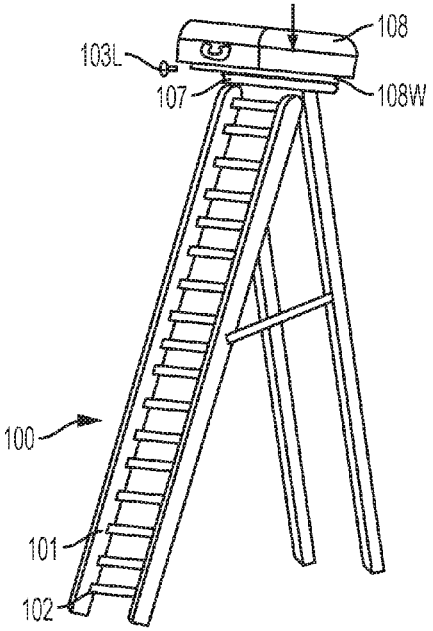
FIG. 6 illustrates a sixth embodiment of a ladder according to the invention.

FIG. 6 illustrates a ladder 100 that has a top cap 107 disposed at the top of side rails 101. Persons skilled in the art will recognize that the ladder 100 shown in FIG. 6 is a step ladder, and that the concept disclosed herein can apply to any other ladders that can support a top cap 107. A case 108, such as a power tool kit box, an accessories box, etc. can have a rim or wall 108 with substantially the same shape as top cap 107, so that case 108 can nest on top cap 107. Persons skilled in the art can recognize that these cases 108 may be custom configured to meet the requirements of the specific needs or trade of the user, as a painter would need different tools than an electrician.

A locking screw 108L can extend through wall 108 and contact top cap 107 or be disposed under top cap 107, so as to fix the position of case 108 (and thus lock case 108) on top cap 107. Other locking systems found in cases, such as over center mechanisms, latches, etc. can be used for the same purpose.

Figure 8:
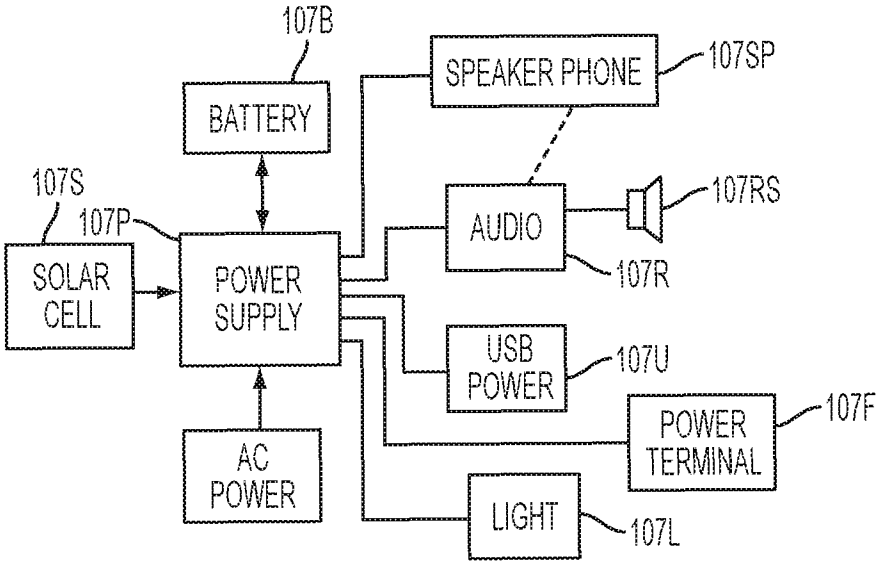
FIG. 8 is a block diagram of the electronic components within the ladder of FIG. 7.
Figure 7:
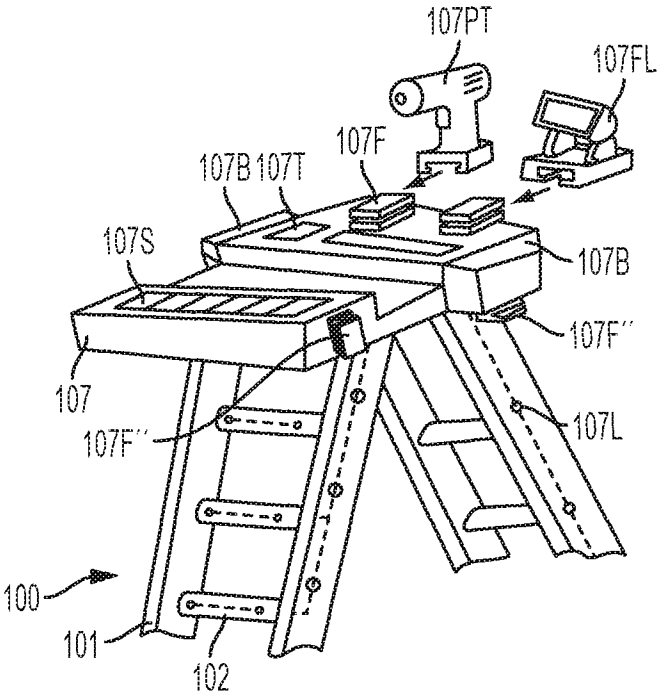
FIG. 7 illustrates a seventh embodiment of a ladder according to the invention.

Referring to FIGS. 7-8, top cap 107 may have a tray 107T for holding tools, battery packs, fasteners, bolts, etc. Top cap 107 may also be engageable to at least one power tool battery pack 107B for holding the battery pack in place until needed by the user.

Similarly, top cap 107 may have a foot protrusion 107F for physically engaging a power tool 107PT. Persons skilled in the art will recognize that foot protrusion 107F will be shaped similarly to the portion of a battery pack that is engageable to power tool 107PT. Because each power tool manufacturer typically has a different battery pack configuration, it is preferable to design foot protrusion 107F to be separable from top cap 107 so that a user can replace the foot protrusion 107F with another foot protrusion that can engage the selected power tool 107PT. It may be appreciated that in some embodiments the foot protrusion 107F may be positioned at an underside of the top cap 107, such as is shown by foot protrusion 107F labeled 107F', or may be located on a side of the top cap 107, such as is shown by the foot protrusion 107F labeled 107F". Accordingly, it may be appreciated that in some embodiments the foot protrusions 107F may facilitate hanging of the power tools 107PT therefrom.

Preferably, top cap 107 may be electrically connectable to battery pack 107B. Top cap 107 may also have a solar cell 107S for converting solar power into electricity. The power outputs of the battery pack 107B and/or solar cell 107S can be provided to a power supply 107P. Power supply 107P may also be connected to AC power. Persons skilled in the art will recognize that power supply 107P may be able to charge battery pack 107B.

Power supply 107P may supply power to the foot protrusion 107F, thus converting foot protrusion 107F into a power terminal for power tool 107PT and/or a light 107FL. In addition, power supply 107P may supply power to lights or LEDs 107L provided on side rails 101 and/or rungs 102. Power supply 107P may also provide power to a USB power output 107U, enabling a user to charge smartphones, etc.

Top cap 107 may also have an audio circuit 107R connectable to a speaker 107RS. The audio circuit 107R could incorporate a radio circuit. In addition, top cap 107 may have speakerphone module 107SP, which is connectable to the user's cell phone, via BlueTooth® for example. The cell phone's audio output can be processed via the audio circuit 107R and heard via speaker 107RS. Speakerphone module 107SP preferably has a microphone (not shown) so that the user can have a full conversation with a caller.

Figure 9:
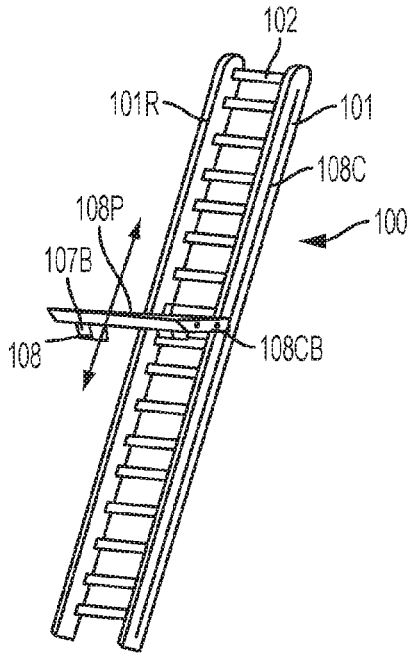
FIG. 9 illustrates an eighth embodiment of a ladder according to the invention.
Figure 10:
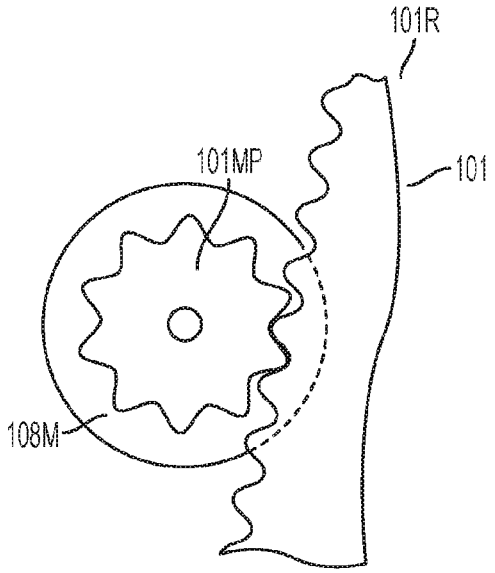
FIG. 10 illustrates a mechanism in the ladder of FIG. 9.

Referring to FIGS. 9-10, a platform 108 can be mounted unto ladder 100. Side rails 101 may have a channel 108C that receive protrusions (not shown) of platform 108.

Preferably platform 108 has a motorized mechanism for lifting and/or lowering platform 108, which could be used to lift materials. In particular, platform 108 may have at least one motor 108M driving a pinion 108MP that engages a rack 101R on each side rail. Motor(s) 108M may be powered by a battery pack 107B mounted on platform 108. Alternatively, motors 108M may be powered by a power cord.

Platform 108 may also have control buttons 108CB to control motor(s) 108M and the directional rotation of pinions 108MP, and thus the direction of movement for platform 108 along ladder 100.

Figure 11:
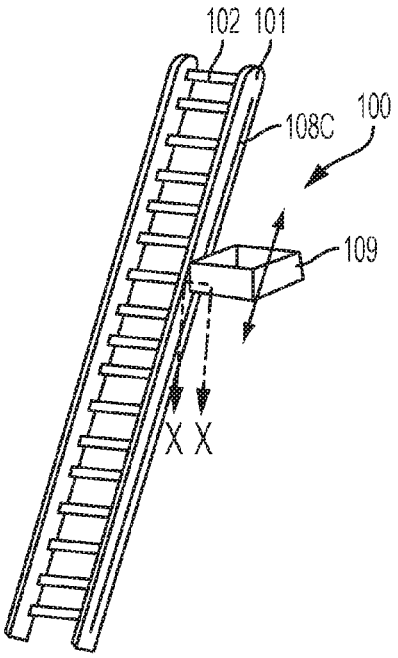
FIG. 11 illustrates a ninth embodiment of a ladder according to the invention.
Figure 12:
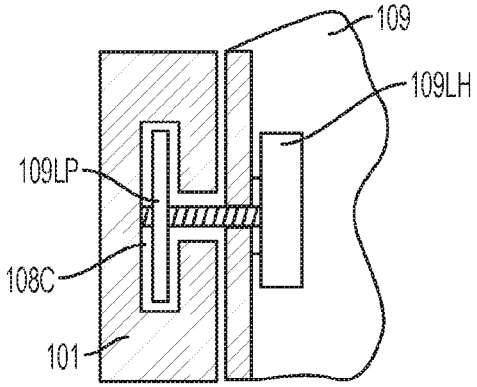
FIG. 12 illustrates a cross-section along line X-X of FIG. 11.
Figure 13:
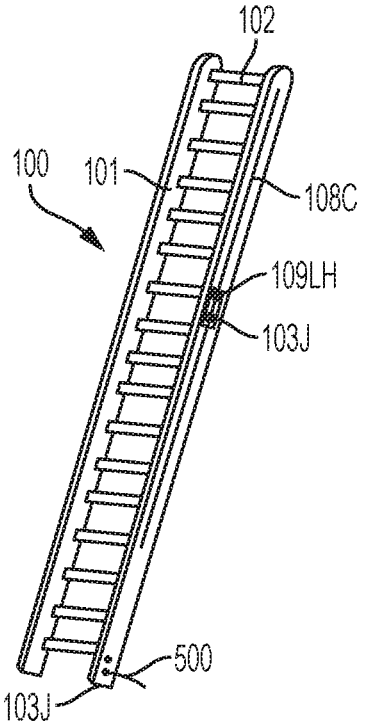
FIG. 13 illustrates a tenth embodiment of a ladder according to the invention.

Referring to FIGS. 11-12, it may be preferable to provide a mechanism for movably attaching accessories, such as support platforms or bins 109, etc. to side rail 101. This can be accomplished by providing a lock plate 109LP within channel 108C. A knob or handle 109LH can extend through bin 109 and threadingly engage lock plate 109LP. In order to lock bin 109 in the desired position, the user would need to rotate handle 109LH, bringing lock plate closer towards bin 109. Bin 109 would be locked when side rail 101 and bin 109 become tightly sandwiched between lock plate 109LP and handle 109LH.

Persons skilled in the art shall recognize that lock plate 109LP and channel 108C could be used to support all sorts of accessories. For example, referring to FIG. 13, an outlet 103J can be slidably mounted to side rail 101 along channel 108C. Outlet 103J would carry a handle 109LH to lock the position of outlet 103J along side rail 101. Such outlet 103J is preferably connected to the outlet 103J disposed at the bottom end of side rail 101.

Figure 14:
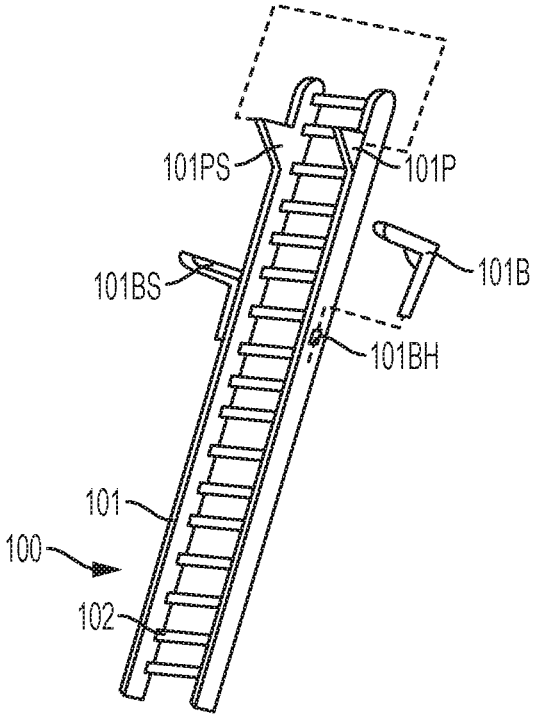
FIG. 14 illustrates an eleventh embodiment of a ladder according to the invention.

Referring to FIG. 14, side rails 101 may each have a protrusion 101P. Preferably protrusions 101P have a top surface 101PS which are substantially coplanar. With such arrangement, a user can dispose an object thereon.

Side rails 101 may also have a bracket holder 101BH that receives a bracket 101B. Bracket 101B may be captured within bracket holder 101BH, or may be removable therefrom. Like protrusions 101P, brackets 101B may have a top surface 101BS which are substantially coplanar. With such arrangement, a user can dispose an object thereon. Preferably, a user can rotate bracket 101B about bracket holder 101BH when not needed so bracket 101B does not interfere with the user's movement up and down the ladder.

Figure 16:
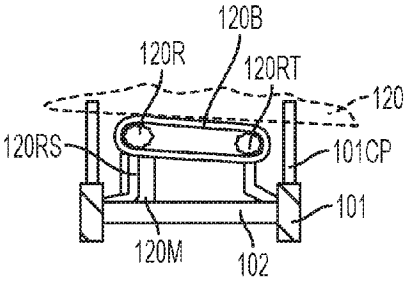
FIG. 16 illustrates the ladder moving mechanism of the ladder of FIG. 15.
Figure 15:
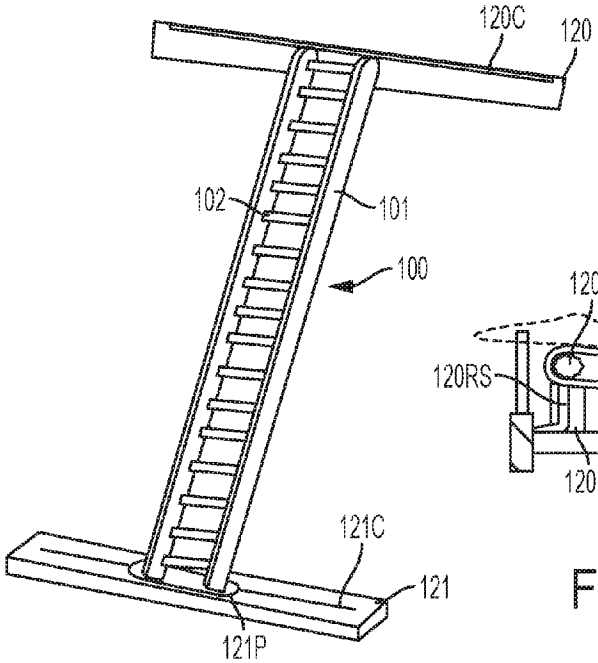
FIG. 15 illustrates a twelfth embodiment of a ladder according to the invention.

Referring to FIGS. 15-16, ladder 100 is connected to support platforms 120, 121 that can be disposed against a wall and floor, respectively. Side rails 101 may have protrusions 101CP which engage a channel 120C in support platform 120. Rollers 120R may be attached to side rails 101 via supports 120RS. At least one motor 120M may be rotationally connected to roller(s) 120R so that, when motor 120M is activated, roller(s) 120R rotate. Rollers 120R may contact the support wall and/or platform 120.

It may be advantageous to provide a continuous track band 120B between rollers 120. Band 120B may contact the support wall and/or platform 120. Rollers 120R may have teeth 120RT that engage band 120B for enhanced driving thereof.

Side rails 101 may be disposed on a sliding platform 121P which is slidingly disposed on channel 121C of support platform 121.

With such arrangement, a user can cause ladder 100 to move sideways without having to climb down ladder 100. This can be accomplished by activating motor(s) 120M to rotate in a desired direction, causing rollers 120R and/or band 120B to rotate. As rollers 120R and/or band 120B contact the support wall and/or support platform 120, they force ladder 100 to move sideways along channels 120C, 121C.

Figure 17:
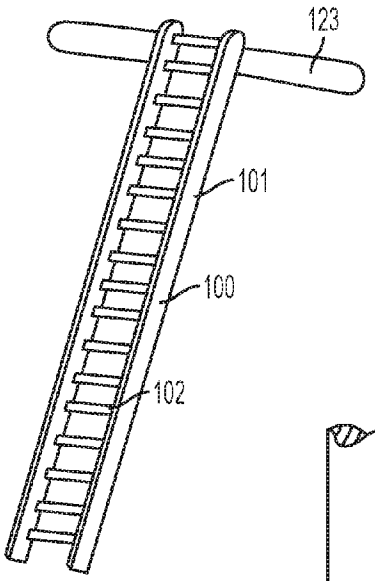
FIG. 17 illustrates a thirteenth embodiment of a ladder according to the invention.
Figure 18:
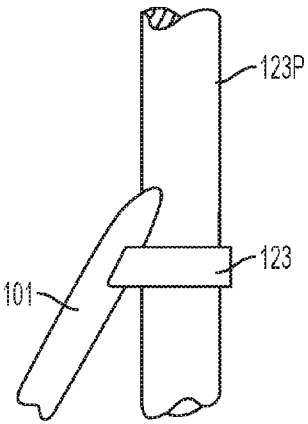
FIG. 18 illustrates the ladder of FIG. 17 in operation.

Referring to FIGS. 17-18, ladder 100 has extensions 123 connected to side rails 101. Extensions 123 may be bistable spring bands, and preferably layered, flexible stainless steel bistable spring bands that can move between a first extended position and a second position surrounding a support or pole 123P. Preferably, the first extended position is substantially flat, while the second position is curled. Persons skilled in the art will recognize that a smaller bistable spring band is described in US Publication No. 20130044215, entitled "BI-STABLE SPRING WITH FLEXIBLE DISPLAY" and filed on Aug. 17, 2011, which is hereby incorporated by reference.

Figure 19:
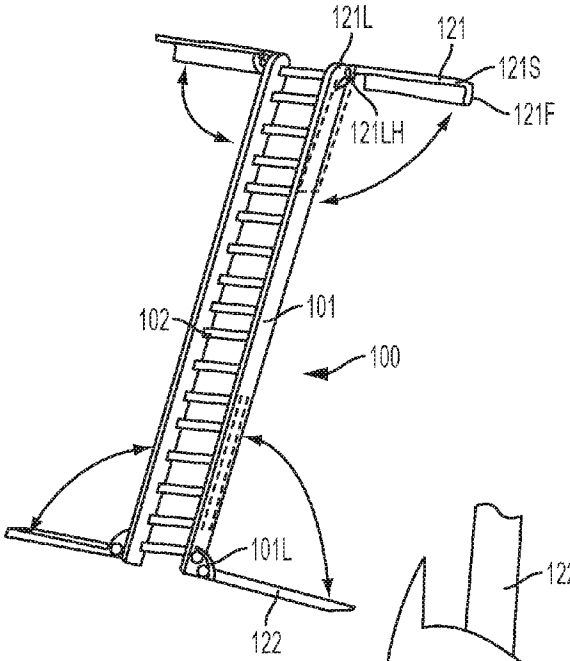
FIG. 19 illustrates a fourteenth embodiment of a ladder according to the invention.
Figure 20:
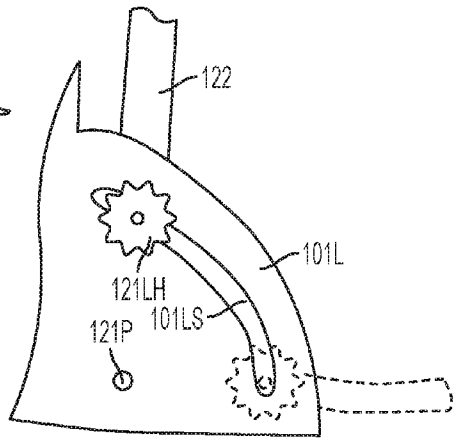
FIG. 20 illustrates a locking mechanism for the extension supports of the ladder of FIG. 19.

Referring to FIGS. 19-20, ladder 100 may have support extensions 121, 122, which may be moved between a first retracted position (preferably adjacent to side rail(s) 101) and to a second extended position. Support extensions 121, 122 may be rotated between the first and second positions.

Support extensions 121, 122 are preferably pivotally connected to a flange 101L connected to side rail 101 at pivot 121P. Flange 101L may have a curved slot 101LS which is substantially concentric with pivot 121P. A locking handle 121LH may be threadingly engaged to support extension 121, 122, so that the user can fix the position of support extension 121, 122 along slot 101LS by rotating handle 121LH.

Preferably, support extension 121 has a support surface 121S which is substantially horizontal in the second position, and can be used to support items disposed thereon. Support extension 121 may also have a flange 121F for contacting the supporting wall in the second position, thus enhancing the stability of ladder 100. Flange 121F may nest behind side rail 101 when support extension 121 is in the first position in order to minimize the volume of ladder 100 for storage. Similarly, support extension 122 may contact the support floor in the second position, thus enhancing the stability of ladder 100.

Figure 21:
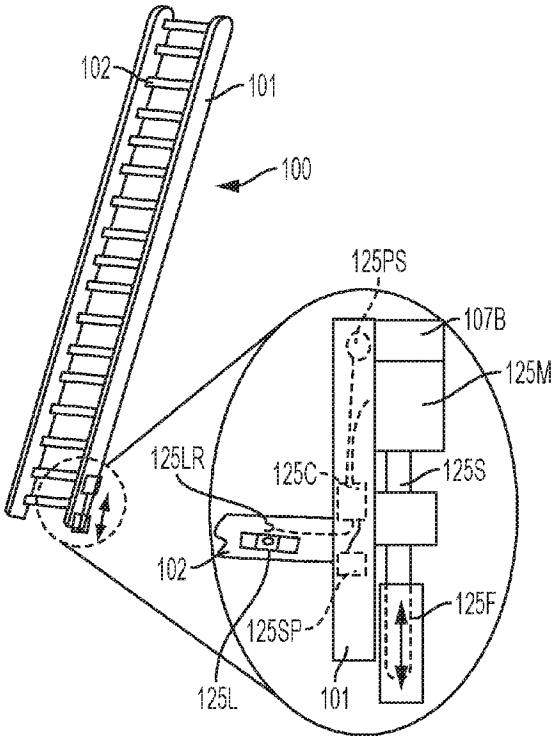
FIG. 21 illustrates a fifteenth embodiment of a ladder according to the invention.

Referring to FIG. 21, ladder 100 preferably has a self-leveling mechanism. Preferably, an inclination sensor 125L may be disposed in rung 102. Sensor 125L may constitute a bubble level with a bubble position reader 125LR, or an electronic sensor, such as an inclinometer, accelerometer or gyroscope sensors. For further information on such sensors, persons skilled in the art are referred to U.S. Pat. Nos. 6,647,634, 7,380,345, 7,447,565, and 8,661,701, which are hereby incorporated fully by reference.

The output of inclination sensor 125L may be provided to a controller 125C, which in turns controls a motor 125M. Motor 125M can rotate a shaft 125S which is threadingly engaged to a foot portion 125F. As shaft 125S rotates, foot portion 125F moves along the axis of shaft 125S because foot portion 125F is not allowed to rotate. Such motion effectively causes ladder 100 to pivot about the other side rail 101. As ladder 100 pivots, inclination sensor 125L continues to provide information for controller 125C in a closed feedback loop, allowing controller 125C to level ladder 100.

Controller 125C may also send an audio signal to speaker 125SP to audibly inform the user when the self-leveling operation is being conducted (and alerting the user to not climb ladder 100 until the self-leveling operation is completed), and/or alerting the user when the self-leveling operation is completed. An audio signal can also be used to indicate to the user that ladder 100 is beyond the self-leveling range.

Persons skilled in the art will recognize that a power tool battery pack 107B can be used to power motor 125M via a power supply circuit 125PS.

As noted above with reference to FIG. 7, in some embodiments the foot protrusions 107F may be positioned on the top cap 107 so that the power tool 107PT may hang under or hang alongside the top cap 107 when the power tool 107PT engages the foot protrusion 107F. Similarly, as noted above, in some embodiments the foot protrusion 107F may be detachable from the top cap 107 so as to facilitate replacement of a foot protrusion 107F associated with one power tool 107PT with a foot protrusion 107F associated with a different power tool 107PT.

Figure 23:
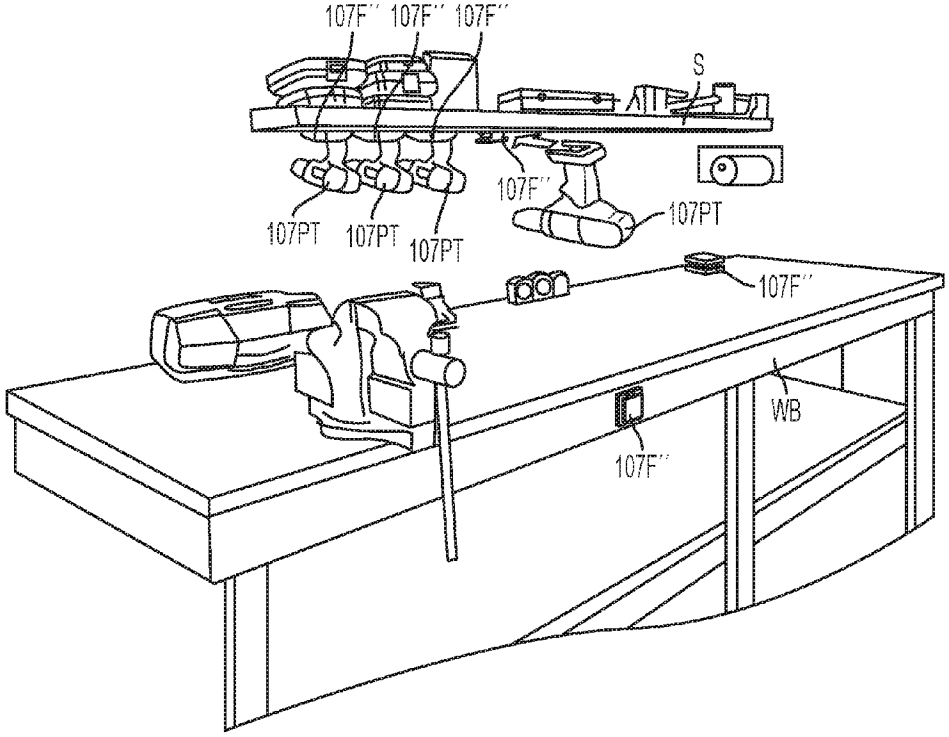
FIG. 23 illustrates an embodiment of securing the power tool storage apparatus for storage of power tools.
Figure 22:
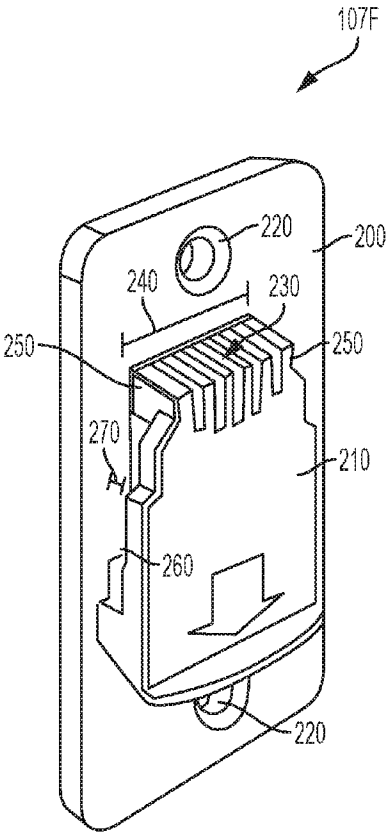
FIG. 22 illustrates an embodiment of a power tool storage apparatus according to the invention.

In an embodiment, the foot protrusion 107F may be separately mountable so as to facilitate tool storage outside of the context of securement to the top cap 107 or even outside of the context of being in association with the ladder 100. For example, an embodiment of foot protrusion 107F is illustrated in isolation in FIG. 22. As shown, in an embodiment the foot protrusion 107F may include a base portion 200 and a tool engaging portion 210. In some embodiments, the base portion 200 may include fastener holes 220, which may receive screws, bolts, or other fasteners therein which may secure the foot protrusion 107F to a storage surface, including to an underside surface, a side surface, or even a top surface thereof. For example, such storage surfaces may be formed on a shelf, a hutch, a workbench, the underside of a toolbox lid, or so on. As shown in FIG. 23, the foot protrusions 107F may be mounted under a shelf S (as indicated as 107F'), or to the side of a work bench WB (as indicated as 107F") or even to the top of the work bench WB (as indicated as 107F'"). It may be appreciated that mounting the foot protrusion 107F to the upper surface of a storage surface may hold the power tool 107PT in an upright position, such as for storage display thereof, while mounting to the underside or side of a storage surface may facilitate hanging storage thereof.

In an embodiment, the base portion 200 may have other engagement features that may releasably secure the base portion 200 to the storage surface, which may facilitate replacing the foot protrusion 107F with other foot protrusions 107F configured for use with other tools.

As noted above, it may be appreciated that in some embodiments different foot protrusions 107F may be shaped to engage different power tools 107PT. Accordingly, the tool engaging portion 210 may vary across embodiments, and may be associated with differing tools. While in some embodiments, such as that illustrated in FIG. 22, the tool engaging portion 210 may include a particular key pattern 230 and a particular key width 240, in other embodiments the tool engaging portion may be designed to accommodate a plurality of shapes on the power tools 107PT that receive the key pattern 230. Similarly, in an embodiment the tool engaging portion 210 may be configured to have an adjustable associated key width 240. For example, in an embodiment opposing faces 250 of the tool engaging portion 210 that are separated to define the key width 240 may be spring biased or otherwise adjustable in spatial relation to each other, so that the key width 240 may vary. Similarly, in an embodiment, the separation of an inner face 260 away from the base portion 200 may be adjustable (e.g., through spring bias or through other similar mechanisms), so as to facilitate modifying a protrusion extension distance 270, further facilitating utilization of a single foot protrusion 107F with multiple power tools 107PT having different battery keys associated therewith.

Persons skilled in the art may recognize other additions or alternatives to the means disclosed herein. However, all these additions and/or alterations are considered to be equivalents of the present invention. For example, it may be appreciated that in an embodiment the teachings associated with the foot protrusion 107F may similarly be applied in inverse form to receive one or more battery configurations for storage of excess batteries. In addition, it may be appreciated that features described herein may be formed by any appropriate known construction mechanism, and from any appropriate material or materials. For example, in some embodiments, features may be integrally formed to one another (e.g., molded, extruded, forged, or so on), or may be formed separately and assembled together (e.g., through screws, bolts, rivets, or other fasteners). Similarly, in some embodiments various features may be formed from one or more of metal, plastic, wood, composites, and so on.

What is claimed is:

1. A power tool storage apparatus, comprising:

a base member shaped to be secured to a storage surface; and a tool engaging portion extending from the base member;

wherein the tool engaging portion is shaped to physically engage a battery pack slot of a power tool, such that attaching the power tool to the tool engaging portion secures the power tool to the storage surface;

wherein the base member includes fastener holes therein positioned and configured to receive a fastener to secure the base member to the storage surface.

2. The power tool storage apparatus of claim 1, wherein the tool engaging portion includes a key pattern thereon associated with a battery slot for a power tool.

3. The power tool storage apparatus of claim 1, wherein the tool engaging portion includes one or more of a fixed key width separating opposing faces of the tool engaging portion, and a fixed protrusion extension distance separating an inner face of the tool engaging portion away from the base member.

4. The power tool storage apparatus of claim 1, wherein the tool engaging portion is integrally molded with the base member.

5. The power tool storage apparatus of claim 1, wherein the base member is configured to be secured to a top cap of a ladder.

* * * * *